US005826716A

United States Patent [19]

Wilson

[11] Patent Number: 5,826,716

[45] Date of Patent: Oct. 27, 1998

[54] WHEEL SEPARATOR AND METHOD

[75] Inventor: LaVerne S. Wilson, Lansing, Mich.

[73] Assignee: Hayes Lemmerz International, Inc., Romulus, Mich.

[21] Appl. No.: 999,668

[22] Filed: Oct. 13, 1997

Related U.S. Application Data

[63] Continuation of Ser. No. 558,969, Nov. 13, 1995, abandoned.

[51] Int. Cl.[6] ..... B65D 85/02

[52] U.S. Cl. ..... 206/304; 206/427; 206/592

[58] Field of Search ..... 206/303, 304, 206/304.1, 386, 597, 503, 427, 821, 588, 589, 592, 394

[56] References Cited

U.S. PATENT DOCUMENTS

| | | | |
|---|---|---|---|
| 1,850,714 | 3/1932 | Gaylord . | |
| 2,597,377 | 5/1952 | Robinson . | |
| 3,265,224 | 8/1966 | Skubic | 206/304 |
| 3,835,986 | 9/1974 | LeBeau . | |
| 3,850,295 | 11/1974 | Black | 206/304 |
| 4,067,442 | 1/1978 | Howe . | |
| 4,474,293 | 10/1984 | Osborne | 206/592 |
| 4,739,884 | 4/1988 | Duplessy | 206/589 |
| 4,998,619 | 3/1991 | Sowa et al. | 206/394 |
| 5,205,410 | 4/1993 | Kuipers et al. | 206/386 |
| 5,311,995 | 5/1994 | Terry | 206/386 |
| 5,353,936 | 10/1994 | Dockstader et al. | 206/597 |
| 5,531,327 | 7/1996 | Darby | 206/394 |

FOREIGN PATENT DOCUMENTS

| | | | |
|---|---|---|---|
| 612249 | 1/1961 | Canada | 206/304 |

*Primary Examiner*—Paul T. Sewell
*Assistant Examiner*—Nhan T. Lam
*Attorney, Agent, or Firm*—MacMillan, Sobanski & Todd, LLC

[57] ABSTRACT

A wheel separator and method for packaging vehicle wheels and the like comprises a multi-ply panel of corrugated fiberboard having at least three liner sheets and two filler layers therebetween. One of the panel faces is generally flat with a plurality of annularly shaped grooves arranged in a spaced apart pattern. Each of the grooves has a base, and opposite sidewalls which extend through at least two adjacent ones of the liner sheets and the associated intermediate filler layer. The groove base is an annular ring cut from the exterior one of the two liner sheets, and is supported by the remaining liner sheets and filler layers. The groove sidewalls are spaced apart a distance substantially commensurate with the thickness of the associated vehicle wheel rim to closely receive the same therein, such that adjacent wheels are prevented from laterally contacting each other, and axial rotation of the wheels is alleviated to avoid cutting vertically through the separator.

25 Claims, 3 Drawing Sheets

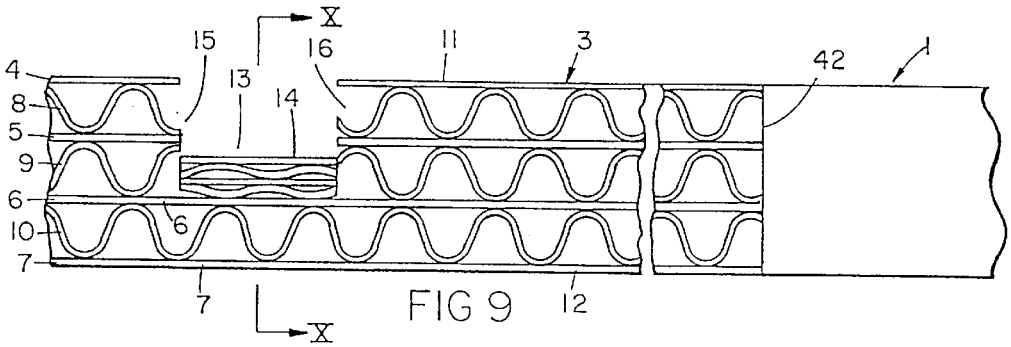
FIG 9
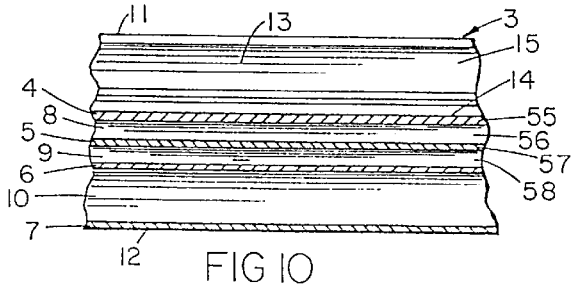
FIG 10
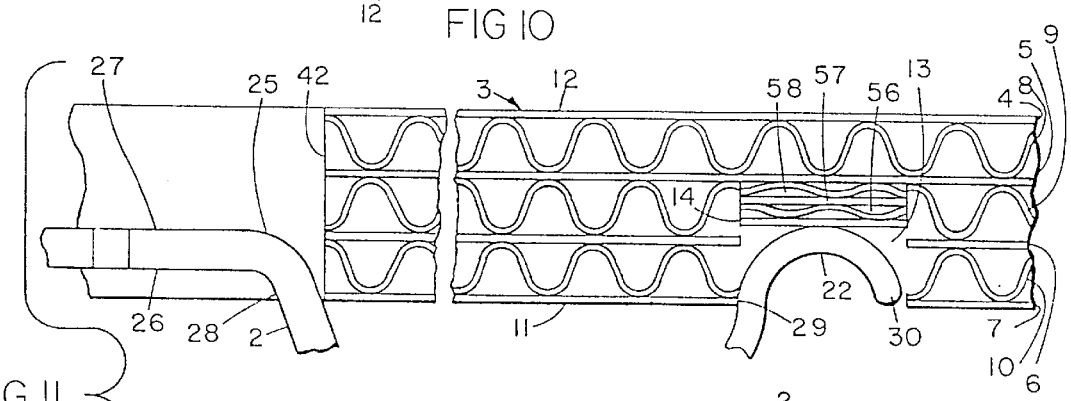
FIG 11
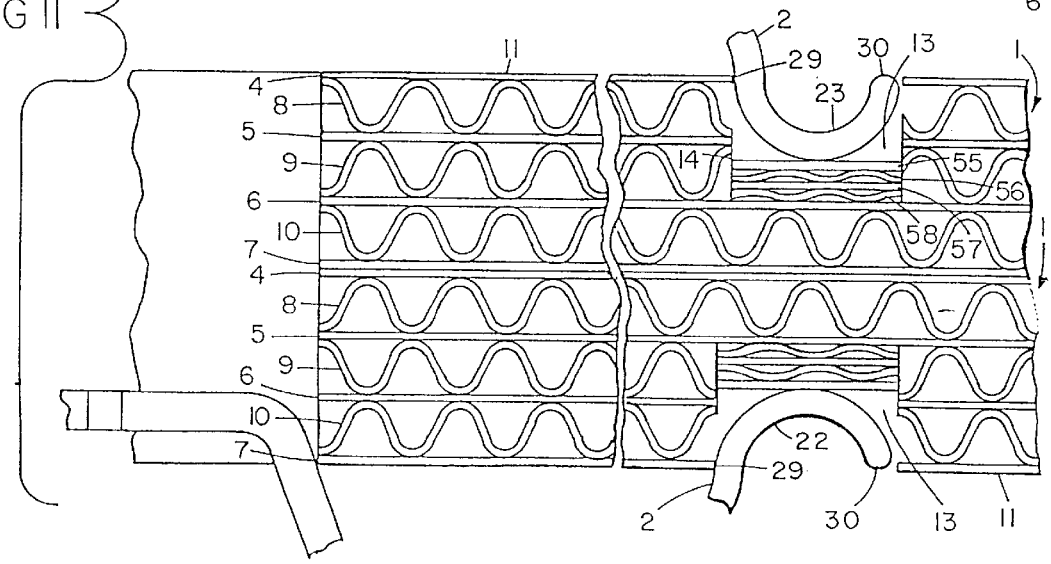

WHEEL SEPARATOR AND METHOD

This application is a continuation of application Ser. No. 08/558,969, filed Nov. 13, 1995, now abandoned.

BACKGROUND OF THE INVENTION

The present invention relates to vehicle wheels and the like, and in particular to a wheel separator and method for packaging vehicle wheels, as well as other similar articles.

Vehicle wheels are typically shipped on conventional pallets, in racks or in individual boxes from their point of manufacture to various final processing and/or assembly locations. Vehicle wheels using cardboard separators are typically nested together in horizontal layers and stacked vertically on the pallets, with a plain sheet of cardboard between each layer. The final package is then banded and/or wrapped together for shipment.

A significant problem experienced with prior packaging techniques relates to finish damage to the wheels, particularly on painted wheels and other types of wheels that have specially finished surfaces. During transport, the vehicle wheels that are horizontally or vertically layered tend to shift, and their adjacent rim portions come into contact, resulting in chipping or otherwise marring the finished surfaces of the wheels. Also, the vehicle wheels tend to rotate axially somewhat as a result of jarring, vibration, etc., which causes the wheel rims to cut through the plain cardboard separators like a cookie cutter, and cause further damage to the finished surfaces of the wheels.

Since finished wheel surfaces are normally produced by very sophisticated processes, under normal circumstances, surface damage to the same cannot be easily repaired on site. Consequently, expensive returns and/or scrap results. The advent of just-in-time vehicle assembly processes has further exacerbated these problems, such that damaged wheels must be repaired or replaced very quickly.

One aspect of the present invention is to provide a wheel separator for packaging vehicle wheels and the like, comprising a multi-ply panel of corrugated fiberboard, having at least three liner sheets separated by at least two filler layers. One of the panel faces is generally flat with a plurality of annularly shaped grooves therein arranged in a predetermined, spaced apart pattern. Each of the grooves has a base and opposite sidewalls which extend through at least two of the liner sheets and at least one of the filler layers. The groove base comprises a ring cut from the exterior one of the liner sheets, and is supported by the remaining liner sheets and the filler layers to abuttingly support an associated vehicle wheel rim thereon. The groove sidewalls are spaced apart a distance substantially commensurate with the thickness of the associated vehicle wheel rim to closely receive the same therebetween for positively preventing adjacent vehicle wheels from laterally contacting each other, while alleviating axial rotation of the vehicle wheels with respect to the panel to avoid cutting vertically through the separator.

Another aspect of the present invention is a method of making wheel separators and the like, comprising providing a multi-ply panel of corrugated fiberboard of the type having at least one exterior liner sheet with an adjacent filler layer thereunder. A first cutting step cuts through the exterior liner sheet and adjacent filler layer of the panel to form a first cut line having a close geometric shape that generally conforms to the outer rim edge of an associated vehicle wheel. A second cutting step cuts through the exterior liner sheet and adjacent filler layer of the panel to form a second cut line, which is spaced from the first cut line, has a closed geometric shape that generally conforms to an inner rim edge of the associated vehicle wheel, and defines between the first and second cut lines ring portions of the exterior liner sheet and the adjacent filler layer. The ring portion of the exterior liner sheet is pressed inwardly toward the center of the panel to inelastically compress the ring portion of the adjacent filler layer, and recess the ring portion of the exterior liner sheet below the balance of the exterior liner sheet to form an annularly shaped groove in which a rim portion of the associated wheel is closely received.

Yet another aspect of the present invention is a method of packaging vehicle wheels and the like, comprising providing a portable base of the type having a generally flat upper surface. A plurality of wheel separators are provided, each of which comprises a lightweight panel with opposite first and second faces thereof oriented in a mutually parallel relationship, wherein the first face is generally flat and uninterrupted, and the second face includes a plurality of annularly shaped grooves to closely receive the rim portions of associated vehicle wheels therein. A first one of the wheel separators is positioned on top of the base, with the first face of the first wheel separator abutting the upper surface of the base, and the second face of the first wheel separator oriented upwardly with the associated grooves thereon opening upwardly. A plurality of vehicle wheels are loaded on the first wheel separator, and arranged on the second face thereof such that lower rim portions of the vehicle wheels are closely received in the grooves of the first wheel separator to define a first layer of vehicle wheels. A second one of the wheel separators is positioned on top of the first layer of vehicle wheels, with the first face of the second wheel separator oriented upwardly, and the second face of the second wheel separator oriented downwardly with the associated grooves thereon opening downwardly to closely receive therein upper rim portions of the first layer of vehicle wheels to positively prevent the vehicle wheels from laterally contacting each other. The first and second wheel separators are then secured to the base to retain the vehicle wheels in their prearranged condition.

Yet another aspect of the present invention is a method of packaging vehicle wheels and the like, comprising providing a portable base. A plurality of vehicle wheels are positioned on top of the base in a predetermined pattern to define a first layer of vehicle wheels. A plurality of wheel separators are provided, each of which comprises a lightweight panel with opposite first and second faces thereof oriented in a mutually parallel relationship, wherein the first face is generally flat and uninterrupted to abuttingly support a layer of vehicle wheels thereon, and the second face includes a plurality of annularly shaped grooves to closely receive the rim portions of associated vehicle wheels therein. A first one of the wheel separators is positioned on top of the first layer of vehicle wheels, with its first face oriented upwardly, and its second face oriented downwardly with the associated grooves thereon opening downwardly to closely receive therein upper rim portions of the first layer of vehicle wheels to positively prevent the vehicle wheels from laterally contacting each other. A second wheel separator is positioned on the first face of the first wheel separator, with its second face oriented upwardly. A plurality of vehicle wheels are positioned on the second face of the second wheel separator in a predetermined pattern to define a second layer of vehicle wheels. The grooves on the second wheel separator open upwardly to closely receive therein lower rim portions of the second layer of vehicle wheels to positively prevent the vehicle wheels in the second layer from laterally contacting each other. The first and second wheel separators are secured to the base to retain the vehicle wheels in their prearranged condition.

The principal objects of the present invention are to provide a wheel separator and method for shipping vehicle wheels and the like without damage. The wheel separator has an uncomplicated design which can be constructed from readily available materials. The wheel separator is economical to manufacture, and is completely recyclable, which particularly adapts the same for a single use. A one-piece, lightweight construction renders the wheel separators easy to use, and minimizes the number of operations and associated effort necessary to load the wheels for shipment. The wheel separators are very durable, yet can be used on a throw-away basis, and are particularly well adapted for the purposed use.

These and other advantages of the invention will be further understood and appreciated by those skilled in the art by reference to the following written specification, claims and appended drawings.

BRIEF DESCRIPTION OF THE DRAWINGS

FIG. 9 is a fragmentary, vertical, cross-sectional view of the finished wheel separator.

FIG. 10 is a fragmentary, vertical, cross-sectional view of the finished wheel separator, taken along the line X—X, FIG. 9.

FIG. 11 is a fragmentary, vertical, cross-sectional view of three wheel separators, shown with portions of associated vehicle wheels mounted therein.

DETAILED DESCRIPTION OF THE PREFERRED EMBODIMENTS

Figure 2:
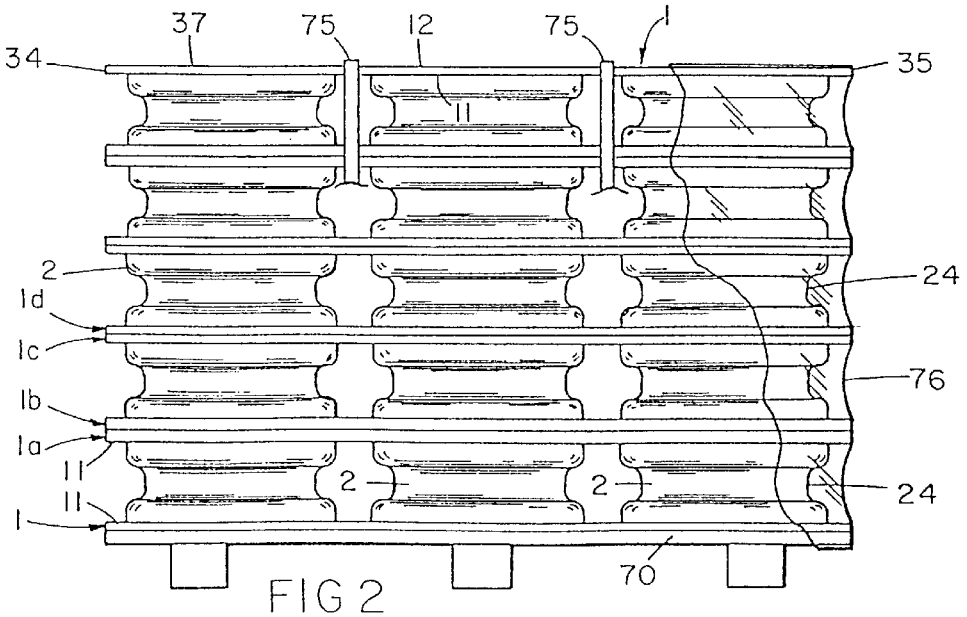
FIG. 2 is a partially schematic, side elevational view of a plurality of the wheel separators shown packaging vehicle wheels on a pallet.

For purposes of description herein, the terms "upper," "lower," "right," "left," "rear," "front," "vertical," "horizontal" and derivatives thereof shall relate to the invention as oriented in FIG. 2. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions, and other physical characteristics relating to the embodiments disclosed herein are not to be considered as limiting, unless the claims expressly state otherwise.

The reference numeral 1 (FIGS. 1 & 2) generally designates a wheel separator embodying the present invention. Wheel separator 1 is particularly adapted for packaging vehicle wheels 2, although other similar types of articles are also contemplated. Wheel separator 1 comprises a multi-ply panel 3 of corrugated fiberboard, having at least three liner sheets 4–7 (FIGS. 3–8) and at least two filler layers 8–10 therebetween. One of the panel faces 11 (FIGS. 1 & 2) is generally flat with a plurality of annularly shaped grooves 13 arranged in a spaced apart pattern. Each of the grooves 13 (FIGS. 9–11) has a base 14 and opposite sidewalls 15 and 16, which extend through at least two adjacent ones of the liner sheets 4–7 and the intermediate one of the filler layers 8–10. The groove base 14 is an annular ring cut from the exterior liner sheet 4, and is supported by the remaining liner sheets 5–7 and filler layers 8–10. The groove sidewalls 15 and 16 are spaced apart a distance substantially commensurate with the thickness of an associated vehicle wheel rim to closely receive the same therein, such that adjacent vehicle wheels 2 are positively prevented from laterally contacting each other, and axial rotation of the vehicle wheels is alleviated to avoid vertically cutting through wheel separator 1.

The illustrated wheel separator 1 (FIGS. 1 & 2) is particularly adapted for packaging painted truck wheels of the type having opposite rim portions 22 and 23 (FIG. 11) with a well 24 (FIG. 2) disposed therebetween. As best illustrated in FIG. 11, each of the illustrated truck wheels 2 has a frustroconical shaped disc 25 that includes an annular center ring 26 with apertures 27 through which studs are received to mount the wheel 2 on an associated vehicle axle (not shown), and an offset portion 28, which may include windows (not shown). In the illustrated example, the rim portions 22 and 23 of truck wheel 2 are arcuate or radiused, with inner and outer edges 29 and 30 respectively. It is to be understood that the present invention also contemplates use with other types of vehicle wheels 2, as well as other similar articles.

The illustrated panel 3 (FIGS. 3–8) is constructed from corrugated paperboard, comprising four liner sheets 4–7, which are separated by three filler layers 8–10. Panel 3 has a substantially conventional construction, wherein filler layers 8–10 are corrugated, and are adhered to flat liner sheets 4–7 by glue or the like. In the example illustrated in FIGS. 1 & 2, panel 3 has a substantially square plan configuration, comprising mutually perpendicular side edges 34–37, and opposite sides or faces 11 and 12, which are generally flat and mutually parallel. In the illustrated example, face 12 of panel 3 is plain or uninterrupted, and the opposite face 11 of panel 3 has annular grooves 15 thereon.

Figure 1:
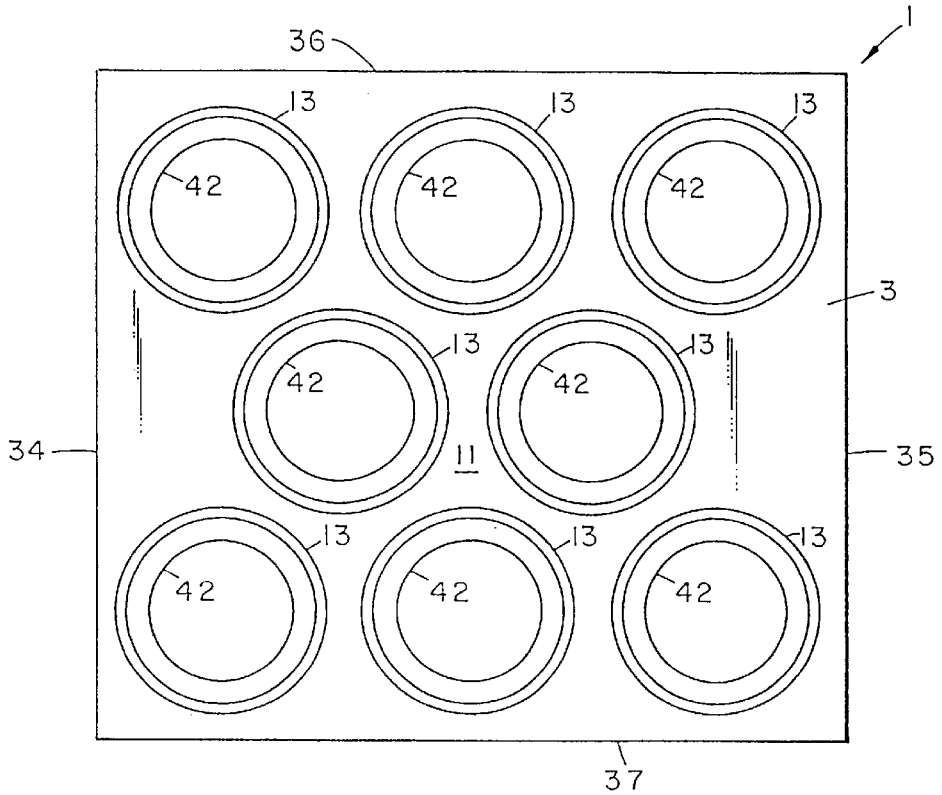
FIG. 1 is a plan view of a wheel separator embodying the present invention.

In the illustrated example, the annular grooves 15 have a substantially identical construction, and are mutually positioned in a nested or staggered row configuration, such as the pattern illustrated in FIG. 1, to efficiently package vehicle wheels 2. In the example illustrated in FIGS. 9–11, groove base 14 is disposed adjacent a medial portion of filler layer 9, such that groove sidewalls 15 and 16 extend along liner sheets 4 and 5, filler layer 8, and approximately one-half of filler layer 9. As described in greater detail hereinafter, the cut ring portions 56 and 58 of filler layers 8 and 9 are compressed to form groove 13. Groove sidewalls 15 and 16 are spaced apart a distance substantially commensurate with or just slightly greater than the thickness of the associated vehicle wheel rims 22 and 23 to closely receive the same therebetween and frictionally retain the vehicle wheels against axial rotation in wheel separator 1.

The illustrated wheel separator 1 (FIG. 1) also includes a plurality of apertures 42 which extend through the panel 3, and are positioned within and generally concentric with the annular grooves 13. In the illustrated example, apertures 42, as well as annular grooves 13, have a circular plan configuration. Apertures 42 are shaped to receive the center ring portion 26 of wheel disc 25 therein, without contacting the same, as shown in FIG. 11. Apertures 42 thereby provide clearance to receive the wheel disc 25, with the center ring portion 26 being disposed below panel liner sheet 4, such that the disc center portion 26 is recessed within the interior of panel 3 to prevent contact with vertically adjacent vehicle wheels 2. Apertures 42 also serve to reduce the weight of wheel separator 1, and the associated circular offal pieces of paperboard may be used to package other articles, or be otherwise converted to usable products.

Figure 3:
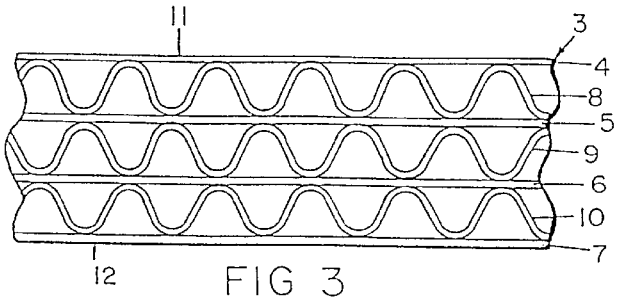
FIG. 3 is a vertical, cross-sectional view of a multi-ply panel of corrugated fiberboard from which the wheel separator is made.
Figure 4:
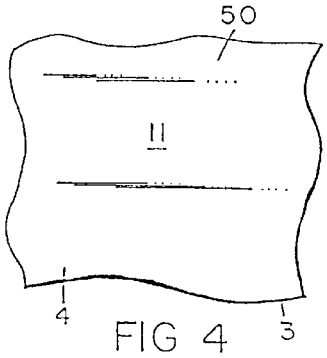
FIG. 4 is a plan view of the panel shown in FIG. 3.
Figure 5:
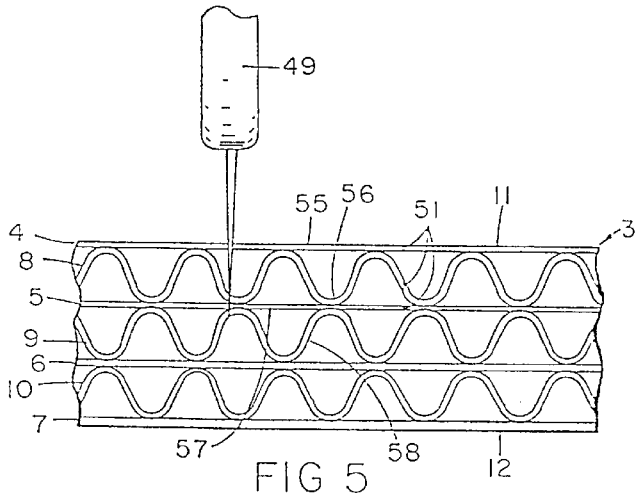
FIG. 5 is a vertical, cross-sectional view of the panel, showing cutting through an exterior face thereof.
Figure 6:
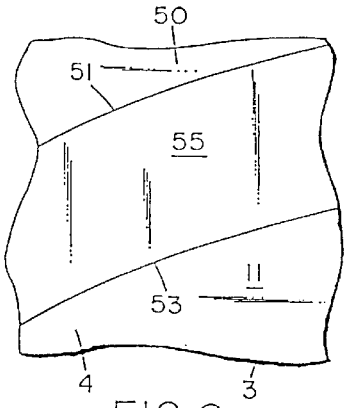
FIG. 6 is a plan view of the cut panel shown in FIG. 5.
Figure 7:
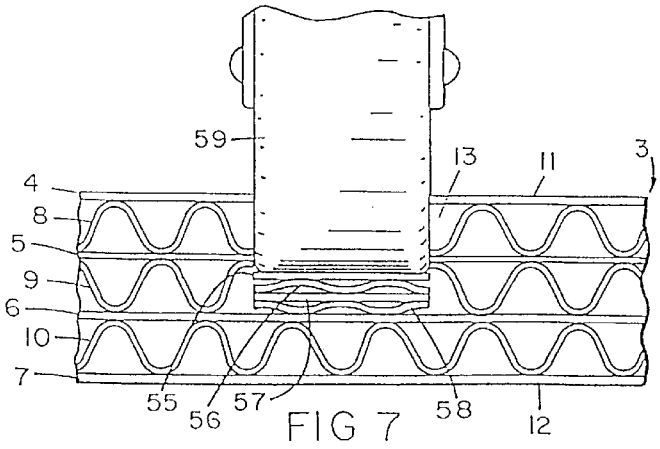
FIG. 7 is a vertical, cross-sectional view of the cut panel, showing a compressing operation which forms an annular groove.
Figure 8:
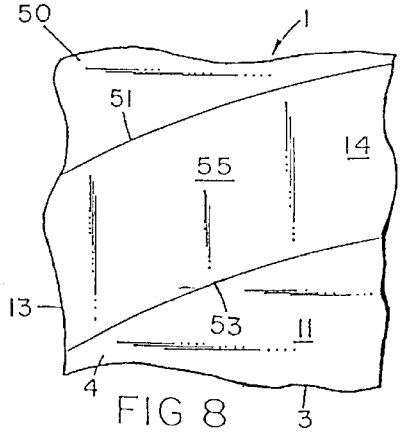
FIG. 8 is a plan view of the compressed panel shown in FIG. 7.

With reference to FIGS. 3–8, a unique process is provided for manufacturing wheel separator 1. A panel blank 50, as shown in FIGS. 3 & 4, is first cut from the four-ply, corrugated fiberboard described hereinabove in the dimensions of the final wheel separator panel 3. The corrugated fiberboard blank 50 is then cut through exterior face 11 in the following manner. With reference to FIGS. 5 & 6, liner sheets 4 and 5, and intermediate filler layer 8 of panel blank 50, are cut with a knife 49, blade, die, or the like to form a first cut line 51 having a closed geometric shape that generally conforms to or is slightly greater than the outer edge 30 of wheel rim portions 22 and 23 of the vehicle wheel 2. Liner sheets 4 and 5 and intermediate filler layer 8 of panel blank 50, are also cut by a knife 49, blade, die, etc. to form a second cut line 53, which is spaced radially, inwardly from the first cut line 51, and has a closed geometric shape that generally conforms to or is slightly less than the inner edge 29 of wheel rim portions 22 and 23. Cut lines 51 and 53 may be formed simultaneously by dual bladed tools, dies, or the like. In any event, cut lines 51 and 53 define therebetween four ring portions 55–58 of liner sheets 4 and 5 and intermediate filler layer 8. As shown in FIGS. 7 & 8, the ring portion 55 of liner sheet 4 is pressed inwardly toward the center of panel blank 50 to inelastically compress the ring portions 56 and 58 of filler layers 8 and 9, and thereby recess the ring portion 55 of liner sheet 4 below the balance of panel face 11 to form annularly shaped groove 13. In the example illustrated in FIG. 7, a roller 59 is used to compress the ring portions 55–58 of the cut panel blank 50 and form annular groove 13. Other types of compressing devices, such as a press, etc. can also be used to compress panel ring portions 55–58.

In one working embodiment of the present invention, panel blank 50 has a total thickness of approximately ½–¾ inch, and filler layers 8 and 9 are nearly completely compressed, such that groove 13 has a depth of around ⅛–¼ inch, with ring portion 57 recessed to a position adjacent the lower portion of filler layer 9, as viewed in FIGS. 9 & 10, and ring portion 55 recessed to a position adjacent the upper portion of filler layer 9. The groove 13 of the subject working embodiment of wheel separator 1 has a width in the range of ⅜–½ inch, which is around ⅛–¼ inch greater than the width of the associated wheel rim portions 22 and 23 to closely receive the same therein, and a diameter of approximately two feet. Preferably, wheel separator 1 is especially configured to accommodate a particular vehicle wheel, such that many other shapes and sizes of wheel separator 1 are also contemplated.

Wheel separators 1 may also be constructed in a double thickness embodiment to accommodate some of the wheel packaging techniques discussed in greater detail below. In one such example, the panel blank 50 is provided with a double length that is twice that of its width, and sixteen grooves 13 are formed in the manner described above on the face 11 thereof. A cut line is provided laterally along the longitudinal center of the blank to divide the same into two identical halves, and extends through liner sheets 4–6 and filler layers 8–10, such that liner sheet 7 acts as a living hinge along the cut line to rotatably interconnect the opposite halves of the double thickness wheel separator 1. The opposite halves of the double thickness wheel separator 1 can be folded on top of one another along the hinge for use in place of two separate wheel separators 1 in the stacked configuration shown in FIG. 2.

In operation, wheel separators 1 may be used in the following fashion to package vehicle wheels 2 on a portable base 70 (FIG. 2), such as the illustrated conventional pallet. A first one of the wheel separators 1 is positioned on top of base 70, with the plain face 12 abutting the upper surface of base 70, and the grooved face 11 oriented upwardly with the associated grooves 13 thereon opening upwardly. A plurality of vehicle wheels 2 are positioned on the first wheel separator 1, and arranged on its grooved face 12 such that the lower rim portions 24 of vehicle wheels 2 are closely received in the grooves 13 of the first wheel separator 1 to define a first layer of vehicle wheels. The grooves 13 on wheel separator 1 provide a visual guide as to where the vehicle wheels 2 are to be placed, such that loading the wheels for shipment is easier and more efficient than when plain cardboard separators are used. A second one of the wheel separators 1*a* (FIG. 2) is then positioned on top of the first layer of vehicle wheels 2, with the plain face 12 of the second wheel separator 1*a* oriented upwardly, and the grooved face 11 of the second wheel separator 1*a* oriented downwardly with the associated grooves 13 thereon opening downwardly to closely receive therein the upper rim portions 22 of the first layer of vehicle wheels 2 to positively prevent the vehicle wheels 2 from laterally contacting each other. The disc portions 25 of vehicle wheels 2 extend into panel apertures 42, but do not contact the side edges thereof. A third one of the wheel separators 1*b* is then positioned on top of the second wheel separator 1*a*, with its plain face 12 abutting the plain face 12 of the second wheel separator 1*a*, and its grooved face 11 oriented upwardly with the associated grooves 13 thereon opening upwardly. The third wheel separator 1*b* is vertically aligned on top of the second wheel separator 1*a*, so that their side edges 34–37 mate. A plurality of vehicle wheels 2 are then positioned on the grooved face 11 of the third wheel separator 1*b* in a nested pattern, such that the lower rim portions 23 of vehicle wheels 2 are closely received in the grooves 13 of third wheel separator 1*b* to define a second layer of vehicle wheels 2. A fourth wheel separator 1*c* is positioned on top of the second layer of vehicle wheels 2, with the plain face 12 of the third wheel separator 1*b* oriented upwardly, and the grooved face 13 of the third wheel separator 1*b* oriented downwardly with the associated grooves 13 thereon opening downwardly to closely receive therein the upper rim portions 22 of the second layer of vehicle wheels 2 to positively prevent the vehicle wheels in the second layer from laterally contacting each other, and to prevent vehicle wheels 2 in the first and second layers from vertically contacting each other. A fifth one of the wheel separators 1*d* is then positioned on top of the fourth wheel separator 1*c*, with its plain face 12 abutting the plain face 12 of fourth wheel separator 1*c*, and its grooved face 11 oriented upwardly with the associated grooves 13 thereon opening upwardly. The fifth wheel separator 1*d* is vertically aligned on top of the fourth wheel separator 1*c* so that their side edges 34–37 mate. Additional layers of vehicle wheels 2 and wheel separators 1 can be loaded onto base 70 in the manner described hereinabove. The completed package is then secured together by bands 75, stretch or shrink wrap 76, and/or other known securing techniques.

It is to be understood that wheel separators 1 can also be used in conjunction with alternative methods and/or techniques for packaging vehicle wheels 2. For instance, the first layer of vehicle wheels 2 can be positioned directly on top of the pallet 2, such as by positioning means like locating blocks, painted indicia, etc., thereby eliminating the first or lower most wheel separator 1 shown in FIG. 2. In this arrangement, the vehicle wheels 2 must be positioned in their predetermined nested pattern without the benefit of separator grooves 13. Also, a single wheel separator 1 can be used between each layer of vehicle wheels, thereby eliminating wheel separators 1*b* and 1*d* from the arrangement shown in FIG. 2. Once again, this arrangement requires that the vehicle wheels 2 be positioned in their predetermined nested pattern on top of the plain faces 12 of wheel separators 1*a* and 1*c*, without the benefit of separator grooves 13. Also, the double thickness embodiment of the wheel separator 1 can be used between adjacent layers of vehicle wheels instead of two back-to-back wheel separators 1. Furthermore, the upper portion of portable base 70 may have a wheel separator 1 formed integrally therein as a one-piece unit. Other uses of wheel separators 1 are also contemplated by the present invention.

Wheel separators 1 serve to positively locate the vehicle wheels 2 in a laterally spaced apart relationship, so that they do not contact each other, thereby preventing damage to their finished surfaces. Furthermore, the rim portions 22 and 23 of the vehicle wheels 2 are closely received within their associated annular grooves 13 in wheel separators 1, so as to alleviate axial rotation of the vehicle wheels 1 with respect to panels 3 to avoid cutting vertically through wheel separators 1. Hence, the vehicle wheels 2 do not vertically come in contact with the nested adjacent layer of vehicle wheels. Since the corrugated fiberboard in panel 3 is completely recyclable, wheel separators 1 can be simply discarded at the receiving site for one-time or throw-away use. Alternately, the wheel separators 1 are sufficiently durable that they can be reused if desired.

In the foregoing description, it will be readily appreciated by those skilled in the art that modifications may be made to the invention without departing from the concepts disclosed herein. Such modifications are to be considered as included in the following claims, unless these claims by their language expressly state otherwise.

I claim:

1. A wheel separator for packaging vehicle wheels each vehicle wheel having a wheel rim portion and a wheel disc portion comprising:

a multi-ply panel of corrugated fiberboard having at least three liner sheets separated by at least two filler layers which define opposite panel faces oriented in a mutually parallel relationship, one of said panel faces being generally flat with a plurality of annularly shaped grooves formed therein arranged in a predetermined spaced apart pattern, each of said grooves extending through at least two of said liner sheets and at least one of said filler layers, each of said grooves defining a groove base comprising an annular ring cut from an exterior one of said liner sheets associated with said one panel face and being supported by the remaining other said liner sheets and said filler layers to abuttingly support the wheel rim portions thereon, and each of said grooves defining a groove lateral width which is generally commensurate with a thickness defined by the associated wheel rim portions to closely receive the same therebetween for positively preventing adjacent vehicle wheels from laterally contacting each other and preventing axial rotation of the vehicle wheels with respect to said panel to avoid cutting vertically through said wheel separator.

2. A wheel separator as set forth in claim 1, wherein:

said one filler layer positioned adjacent said groove base is compressed.

3. A wheel separator as set forth in claim 2, wherein:

said panel includes at least four liner sheets, comprising first, second, third and fourth liner sheets arranged respectively in a vertically stacked relationship.

4. A wheel separator as set forth in claim 3, wherein:

said panel includes at least three filler layers, comprising first, second and third filler layers arranged respectively between said first, second, third and fourth liner sheets.

5. A wheel separator as set forth in claim 4, wherein:

said groove extends through said first filler layer and at least a portion of said second filler layer.

6. A wheel separator as set forth in claim 5, wherein:

said first and second filler layers are compressed.

7. A wheel separator as set forth in claim 6, including:

a plurality of apertures extending through said panel and positioned concentric with said grooves.

8. A wheel separator as set forth in claim 7, wherein:

said apertures are shaped to receive the disc portions of the vehicle wheels therein without contacting the same.

9. A wheel separator as set forth in claim 8, wherein:

said grooves and said apertures each have a generally circular plan shape.

10. A wheel separator as set forth in claim 9, wherein:

the other one of said panel faces is generally flat and uninterrupted.

11. A wheel separator as set forth in claim 10, wherein:

said panel is constructed from corrugated paperboard.

12. A wheel separator as set forth in claim 11, wherein:

said panel includes eight of said grooves and said apertures arranged in a nested pattern.

13. A wheel separator as set forth in claim 12, wherein:

said panel is constructed from a recyclable material.

14. A wheel separator as set forth in claim 1, wherein:

the other one of said panel faces is generally flat and uninterrupted.

15. A wheel separator as set forth in claim 1, wherein:

said panel includes at least four liner sheets, comprising first, second, third and fourth liner sheets arranged respectively in a vertically stacked relationship.

16. A wheel separator as set forth in claim 1, wherein:

said panel includes at least three filler layers, comprising first, second and third filler layers arranged respectively in a vertically stacked relationship.

17. A wheel separator as set forth in claim 1, wherein:

said groove extends through at least portions of two of said filler layers.

18. A wheel separator as set forth in claim 17, wherein:

said at least two filler layers are compressed.

19. A wheel separator as set forth in claim 1, including:

a plurality of apertures extending through said panel and positioned concentric with said grooves.

20. A wheel separator as set forth in claim 19, wherein:

said apertures are shaped to receive the disc portions of the vehicle wheels therein without contacting the same.

21. A wheel separator as set forth in claim 1, wherein:

said grooves have a generally circular plan shape.

22. A wheel separator as set forth in claim 1, wherein:

said panel is constructed from corrugated paperboard.

23. A wheel separator as set forth in claim 1, wherein:

said panel includes eight of said grooves arranged in a nested pattern.

24. A wheel separator as set forth in claim 1, wherein:

said panel is constructed from a recyclable material.

25. A separator for packaging rotatable vehicle components each rotatable vehicle component having a generally annular portion comprising:

a multi-ply panel of corrugated fiberboard having at least three liner sheets separated by at least two filler layers which define opposite panel faces oriented in a mutually parallel relationship, one of said panel faces being generally flat with a plurality of annularly shaped grooves formed therein arranged in a predetermined spaced apart pattern, each of said grooves extending through at least two of said liner sheets and at least one of said filler layers, each of said grooves defining a groove base comprising an annular ring cut from an exterior one of said liner sheets associated with said one panel face and being supported by the remaining other said liner sheets and said filler layers to abuttingly support the rotatable vehicle component thereon, and each of said grooves defining a groove lateral width which is generally commensurate with a thickness defined by the associated annular portions to closely receive the same therebetween for positively preventing adjacent vehicle components from laterally contacting each other and preventing axial rotation of the vehicle components with respect to said panel to avoid cutting vertically through said separator.

* * * * *

UNITED STATES PATENT AND TRADEMARK OFFICE

CERTIFICATE OF CORRECTION

PATENT NO. : 5,826,716

DATED : 10/27/98

INVENTOR(S) : L. Wilson

It is certified that error appears in the above-identified patent and that said Letters Patent is hereby corrected as shown below:

Substitute Claims 1-25 below for Claims 1-25 printed in the above patent.

1. A combination wheel separator for packaging vehicle wheels, the combination wheel separator and vehicle wheels comprising:

a plurality of vehicle wheels, each of said vehicle wheels having a wheel rim portion and a wheel disc portion, said wheel rim portion defining a wheel rim thickness;

a multi-ply panel of corrugated fiberboard having at least three liner sheets separated by at least two filler layers which define opposite panel faces oriented in a mutually parallel relationship, one of said panel faces being generally flat with a plurality of annularly shaped grooves formed therein arranged in a predetermined spaced apart pattern, each of said grooves extending through at least two of said liner sheets and at least one of said filler layers, each of said grooves defining a groove base comprising an annular ring cut from an exterior one of said liner sheets associated with said one panel face and being supported by the remaining other said liner sheets and said filler layers to abuttingly support the wheel rim portions thereon, and each of said grooves defining a groove lateral width which is generally commensurate with said wheel rim thickness defined by said wheel rim portions to closely receive the same therebetween for positively preventing adjacent vehicle wheels from laterally contacting each other and preventing axial rotation of said vehicle wheels with respect to said panel to avoid cutting vertically through said wheel separator.

2. The combination wheel separator and vehicle wheels defined in Claim 1, wherein:

said one filler layer positioned adjacent said groove base is compressed.

3. The combination wheel separator and vehicle wheels defined in Claim 2, wherein:

said panel includes at least four liner sheets, comprising first, second, third and fourth liner sheets arranged respectively in a vertically stacked relationship.

UNITED STATES PATENT AND TRADEMARK OFFICE

CERTIFICATE OF CORRECTION

PATENT NO. : 5,826,716

DATED : 10/27/98

INVENTOR(S) : L. Wilson

It is certified that error appears in the above-identified patent and that said Letters Patent is hereby corrected as shown below:

4. The combination wheel separator and vehicle wheels defined in Claim 3, wherein: said panel includes at least three filler layers, comprising first, second and third filler layers arranged respectively between said first, second, third and fourth liner sheets.

5. The combination wheel separator and vehicle wheels defined in Claim 4, wherein: said groove extends through said first filler layer and at least a portion of said second filler layer.

6. The combination wheel separator and vehicle wheels defined in Claim 5, wherein: said first and second filler layers are compressed.

7. The combination wheel separator and vehicle wheels defined in Claim 6, including: a plurality of apertures extending through said panel and positioned concentric with said grooves.

8. The combination wheel separator and vehicle wheels defined in Claim 7, wherein: said apertures are shaped to receive said disc portions of said vehicle wheels therein without contacting the same.

9. The combination wheel separator and vehicle wheels defined in Claim 8, wherein: said grooves and said apertures each have a generally circular plan shape.

10. The combination wheel separator and vehicle wheels defined in Claim 9, wherein: the other one of said panel faces is generally flat and uninterrupted.

11. The combination wheel separator and vehicle wheels defined in Claim 10, wherein: said panel is constructed from corrugated paperboard.

UNITED STATES PATENT AND TRADEMARK OFFICE

CERTIFICATE OF CORRECTION

PATENT NO. : 5,826,716

DATED : 10/27/98

INVENTOR(S) : L. Wilson

It is certified that error appears in the above-identified patent and that said Letters Patent is hereby corrected as shown below:

12. The combination wheel separator and vehicle wheels defined in Claim 11, wherein: said panel includes eight of said grooves and said apertures arranged in a nested pattern.

13. The combination wheel separator and vehicle wheels defined in Claim 12, wherein: said panel is constructed from a recyclable material.

14. The combination wheel separator and vehicle wheels defined in Claim 1, wherein: the other one of said panel faces is generally flat and uninterrupted.

15. The combination wheel separator and vehicle wheels defined in Claim 1, wherein: said panel includes at least four liner sheets, comprising first, second, third and fourth liner sheets arranged respectively in a vertically stacked relationship.

16. The combination wheel separator and vehicle wheels defined in Claim 1, wherein: said panel includes at least three filler layers, comprising first, second and third filler layers arranged respectively in a vertically stacked relationship.

17. The combination wheel separator and vehicle wheels defined in Claim 1, wherein: said groove extends through at least portions of two of said filler layers.

18. The combination wheel separator and vehicle wheels defined in Claim 17, wherein: said at least two filler layers are compressed.

19. The combination wheel separator and vehicle wheels defined in Claim 1, including: a plurality of apertures extending through said panel and positioned concentric with said grooves.

UNITED STATES PATENT AND TRADEMARK OFFICE

CERTIFICATE OF CORRECTION

PATENT NO. : 5,826,716

DATED : 10/27/98

INVENTOR(S) : L. Wilson

It is certified that error appears in the above-identified patent and that said Letters Patent are hereby corrected as shown below:

20. The combination wheel separator and vehicle wheels defined in Claim 19, wherein: said apertures are shaped to receive said disc portions of said vehicle wheels therein without contacting the same.

21. The combination wheel separator and vehicle wheels defined in Claim 1, wherein: said grooves have a generally circular plan shape.

22. The combination wheel separator and vehicle wheels defined in Claim 1, wherein: said panel is constructed from corrugated paperboard.

23. The combination wheel separator and vehicle wheels defined in Claim 1, wherein: said panel includes eight of said grooves arranged in a nested pattern.

24. The combination wheel separator and vehicle wheels defined in Claim 1, wherein: said panel is constructed from a recyclable material.

UNITED STATES PATENT AND TRADEMARK OFFICE

CERTIFICATE OF CORRECTION

PATENT NO. : 5,826,716

DATED : 10/27/98

INVENTOR(S) : L. Wilson

It is certified that error appears in the above-identified patent and that said Letters Patent is hereby corrected as shown below:

25. A combination separator for packaging rotatable vehicle components, the combination separator and rotatable vehicle components comprising:

a plurality of rotatable vehicle components, each of said rotatable vehicle components having a generally annular portion, said annular portion defining a rotatable vehicle component thickness;

a multi-ply panel of corrugated fiberboard having at least three liner sheets separated by at least two filler layers which define opposite panel faces oriented in a mutually parallel relationship, one of said panel faces being generally flat with a plurality of annularly shaped grooves formed therein arranged in a predetermined spaced apart pattern, each of said grooves extending through at least two of said liner sheets and at least one of said filler layers, each of said grooves defining a groove base comprising an annular ring cut from an exterior one of said liner sheets associated with said one panel face and being supported by the remaining other said liner sheets and said filler layers to abuttingly support the rotatable vehicle component thereon, and each of said grooves defining a groove lateral width which is generally commensurate with said rotatable vehicle component thickness defined by said annular portions to closely receive the same therebetween for positively preventing adjacent vehicle components from laterally contacting each other and preventing axial rotation of the vehicle components with respect to said panel to avoid cutting vertically through said separator.

Signed and Sealed this

Twenty-sixth Day of October, 1999

*Attest:*

*Attesting Officer*

Q. TODD DICKINSON

*Acting Commissioner of Patents and Trademarks*